US009821956B2

(12) United States Patent
Wright

(10) Patent No.: US 9,821,956 B2
(45) Date of Patent: Nov. 21, 2017

(54) LATCH

(71) Applicant: Wastequip, LLC, Charlotte, NC (US)

(72) Inventor: Todd Wright, Statesville, NC (US)

(73) Assignee: WASTEQUIP, LLC, Charlotte, NC (US)

( * ) Notice: Subject to any disclaimer, the term of this patent is extended or adjusted under 35 U.S.C. 154(b) by 464 days.

(21) Appl. No.: 14/493,618

(22) Filed: Sep. 23, 2014

(65) Prior Publication Data

US 2016/0083186 A1 Mar. 24, 2016

(51) Int. Cl.
*B65D 43/22* (2006.01)
*B65F 1/16* (2006.01)

(52) U.S. Cl.
CPC ..... *B65F 1/1615* (2013.01); *B65D 43/22* (2013.01); *B65D 2251/105* (2013.01); *B65D 2251/1058* (2013.01)

(58) Field of Classification Search
CPC ..... B65F 1/1615; B65D 2251/1016; B65D 2251/105; B65D 2251/1058; B65D 43/22
USPC ..... 220/324, 833–835
See application file for complete search history.

(56) References Cited

U.S. PATENT DOCUMENTS

| | | | | | |
|---|---|---|---|---|---|
| 2,481,076 | A * | 9/1949 | Bryant | B61F 15/26 | 220/324 |
| 2,511,852 | A * | 6/1950 | Jackson | A61G 9/003 | 220/212.5 |
| 3,104,903 | A * | 9/1963 | Futch et al. | B65D 45/16 | 220/326 |
| 4,892,341 | A * | 1/1990 | Dietrich | E05B 15/022 | 292/341.12 |
| 5,103,994 | A * | 4/1992 | Doxey | B65D 45/20 | 220/318 |
| 5,776,405 | A | 7/1998 | Prout et al. | | |
| 5,922,267 | A | 7/1999 | Brescia et al. | | |
| 9,327,746 | B2 | 5/2016 | Brokaw | | |
| 2011/0272953 | A1* | 11/2011 | Mercier | B65F 1/02 | 292/195 |
| 2012/0235101 | A1* | 9/2012 | Flannery | E06B 9/04 | 256/24 |

* cited by examiner

*Primary Examiner* — James N Smalley
(74) *Attorney, Agent, or Firm* — Nelson Mullins Riley & Scarborough LLP

(57) ABSTRACT

A latch for a container is disclosed. The latch can comprise a body, which can be mounted to a lid of the container. The latch can further comprise a wheel that is rotatable relative to the body. The latch can engage the receptacle of the container. For example, the wheel can protrude under the rim of the receptacle when the lid is in a closed orientation relative to the receptacle. In other instances, the latch can be mounted to the receptacle of the container, and can releasably engage the lid of the container.

17 Claims, 13 Drawing Sheets

LATCH

FIELD

The present disclosure relates to latches for containers and methods for making and using the same.

BACKGROUND

Containers for refuse and waste are often positioned outside or may be permanently stored outside. When outside, the containers are subjected to various natural elements and weather conditions, such as precipitation and wind, for example. Additionally, the contents in a container can attract wildlife, which can tamper with, or seek to tamper with, the container. Accordingly, a container often includes a receptacle for receiving and holding the refuse, and a lid that protects the contents of the container. A lid can protect the container contents from natural elements, weather conditions, and wildlife. For example, a lid may be attached to the receptacle of a container, and the lid can be held in place relative to the receptacle by gravity.

In certain instances, strong winds can catch the lid of a refuse container, which can cause the lid to prematurely and/or unintentionally open. When the lid is open, the contents of the receptacle are unsecured. Additionally, strong winds can catch an open or partially-open lid and upset or overturn the entire container.

Generally, the lid of the container is moved to empty the container. For example, a hinged lid can pivot relative to the receptacle to open the container and reveal the contents therein. In various instances, containers can be emptied by an automated dumping mechanism that is attached to a collection vehicle. Such a dumping mechanism can grasp, lift and tip the container to affect hinging of the lid and dumping of the contents.

The foregoing discussion is intended only to illustrate various aspects of the related art in the field at the time and should not be taken as a disavowal of claim scope.

SUMMARY

In at least one form, a container can comprise a receptacle, which can comprise a receptacle rim. The container can further comprise a lid movable between an open position and a closed position relative to the receptacle. The lid can comprise a lid rim, and the lid rim can be positioned adjacent to the receptacle rim when the lid is in the closed position. The container can further comprise a latch, which can comprise a flexible body mounted to the lid rim and extending past the receptacle rim when the lid is in the closed position. The latch can further comprise a wheel rotatable relative to the flexible body, and the wheel can protrude under the receptacle rim when the lid is in the closed position.

In at least one form, the lid of the container can be configured to pivot between the open position and the closed position. In at least one form, the flexible body can further comprise an opening, and a portion of the wheel can protrude through the opening.

In at least one form, the latch can further comprise an axle support protruding from the flexible body, and the latch can further comprise an axle. The wheel can be positioned around the axle. In at least one form, the axle support can comprise a first side protruding from the body at a first angle and a second side protruding from the body at a second angle and extending to the first side. The first angle can be different than the second angle. In at least one form, the axle can be positioned between the first side of the axle support, the second side of the axle support, and the flexible body. In at least one form, the axle support can extend under the receptacle rim when the lid is in the closed position. In at least one form, the wheel can be configured to freely rotate as the lid moves between the open position and the closed position.

In at least one form, the flexible body can further comprise a mounting portion mounted to the lid rim, an arm extending from the mounting portion, and a contour intermediate the mounting portion and the arm. The flexible body can be configured to bend at the contour.

In at least one form, the container can further comprise a mounting bracket configured to mount the flexible body to the lid rim. In at least one form, the latch can further comprise a screw, and the body can further comprise a threaded aperture structured and dimensioned to threadably receive the screw.

In at least one form, the latch can be permanently fixed to the lid.

In at least one form, the wheel can comprise a diameter greater than ½ inch. In at least one form, the wheel can comprise a diameter of less than 2 inches. In at least one form, the wheel can comprise a diameter of approximately 1 inch.

In at least one form, the latch can be comprised of high density polyethylene. In at least one form, the receptacle can comprise a rotationally molded receptacle body and a wheel.

In at least one form, a lid for a refuse container can comprise a rim and a latch mounted to the rim. The latch can comprise a body configured to flex between a first orientation and a second orientation, wherein the body can comprise a rim side adjacent to the rim, and wherein the body can extend past the rim of the lid. The latch can further comprise a support protruding from the rim side of the body, and the support can comprise a first side and a second side. The latch can further comprise an axle retained between the first side, the second side, and the rim side of the body. The latch can further comprise a wheel positioned around the axle, and the wheel can be rotatable relative to the body.

In at least one form, the body can further comprise an opening, and a portion of the wheel can protrude through the opening.

In at least one form, a latch for a lid of a refuse container can comprise a flexible body, a support protruding from the flexible body, an axle positioned between the support and the flexible body, and a rotatable wheel positioned around the axle.

In at least one form, the flexible body can comprise a mounting portion and an arm. An opening can be defined through the arm, and a portion of the rotatable wheel can protrude through the opening. In at least one form, the flexible body can further comprise a contour intermediate the mounting portion and the arm. The contour can be configured to bend to move the body between a first configuration and a second configuration.

In at least one form, the support can comprise a first wall protruding from the arm at a first angle and a second wall protruding from the arm at a second angle and extending to the first wall. In at least one form, the first angle can be different than the second angle. In at least one form, the axle can be positioned between the first wall of the support, the second wall of the support, and the flexible body.

In at least one form, a container can comprise a receptacle comprising a receptacle rim, a lid movable between an open position and a closed position relative to the receptacle, and a latch. The lid can comprise a lid rim, and the lid rim can be positioned adjacent to the receptacle rim when the lid is in the closed position. The latch can comprise a flexible body mounted to the receptacle rim and extending past the lid rim when the lid is in the closed position. The latch can further comprise a wheel rotatable relative to the flexible body, wherein the wheel protrudes over the lid rim when the lid is in the closed position.

BRIEF DESCRIPTION OF THE DRAWINGS

Various features and advantages and the manner of attaining them will become more apparent and will be better understood by reference to the following description of embodiments in conjunction with the accompanying drawings, in which.

DETAILED DESCRIPTION

Figure 1:
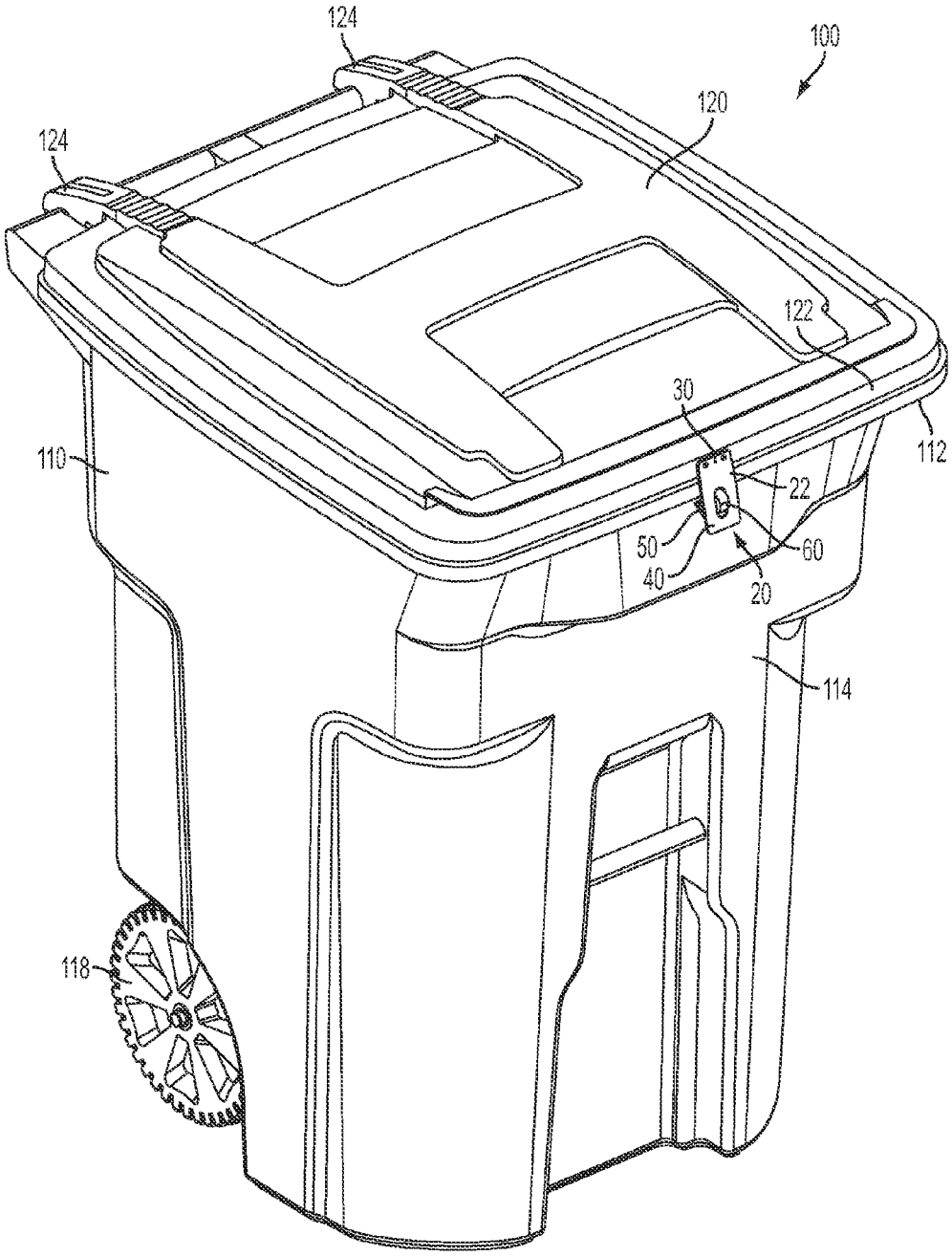
FIG. 1 is a perspective view of a refuse container including a wheeled receptacle, a hinged lid, and a latch, depicting the lid in a closed position relative to the receptacle, according to various embodiments of the present disclosure.
Figure 1A:
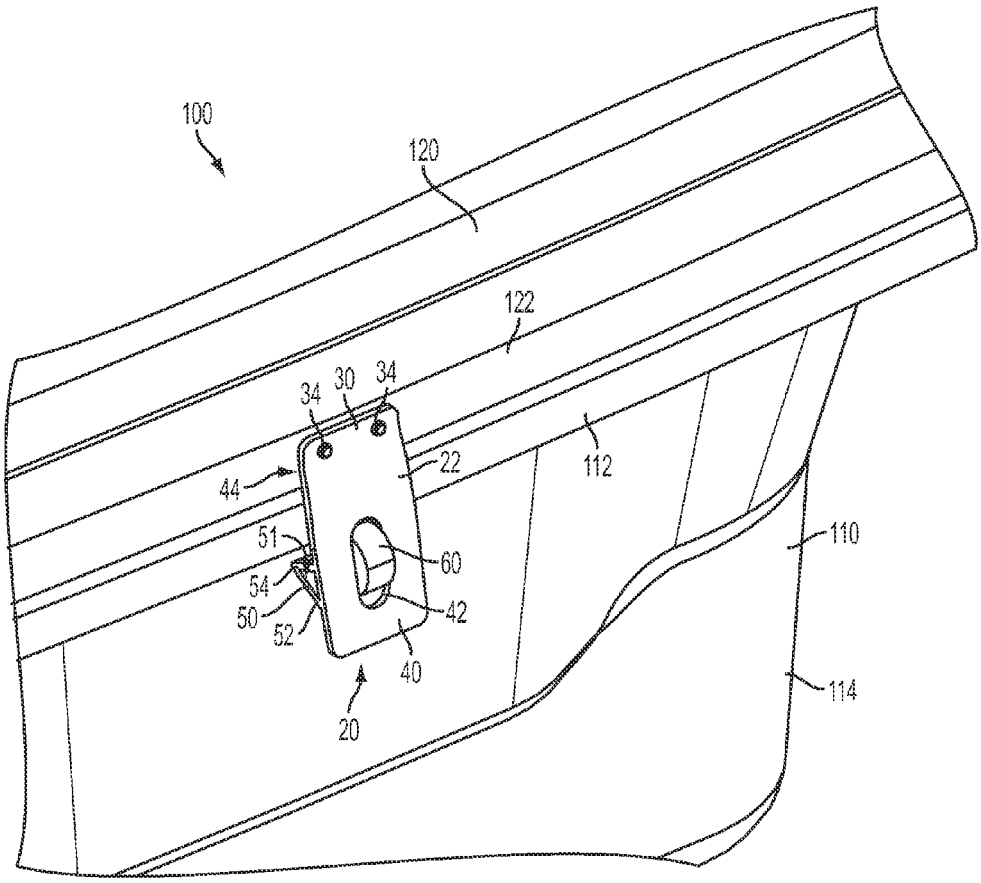
FIG. 1A is a detail view of the refuse container of FIG. 1, depicting the hinged lid in the closed position relative to the receptacle, and further depicting the latch in a flexed orientation, according to various embodiments of the present disclosure.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment", or "in an embodiment", or the like, in places throughout the specification are not necessarily all referring to the same embodiment. Additionally, reference throughout the specification to "various instances," "some instances," "one instance," or "an instance", the like, means that a particular feature, structure, or characteristic described in connection with the instance is included in at least one instance. Thus, appearances of the phrases "in various instances," "in some instances," "in one instance", "in an instance", or the like, in places throughout the specification are not necessarily all referring to the same instance.

Furthermore, the particular features, structures, or characteristics may be combined in any suitable manner in one or more embodiment or instance. Thus, the particular features, structures, or characteristics illustrated or described in connection with one embodiment or instance may be combined, in whole or in part, with the features structures, or characteristics of one or more other embodiment or instance without limitation. Such modifications and variations are intended to be included within the scope of the present invention.

A refuse container 100 is disclosed in FIGS. 1-4. The container 100 includes a receptacle 110, a lid 120 and a latch 20. The latch 20 can secure the lid 120 in a closed position (FIGS. 1-3) relative to the receptacle 110. Moreover, as described in greater detail herein, the latch 20 can operably permit movement of the lid 120 to an open position (FIG. 4) to facilitate dumping of the contents in the receptacle 110. As a result, the refuse container 100 depicted in FIGS. 1-4 can protect the contents thereof from natural elements, weather conditions, and wildlife, even when subjected to strong winds. Additionally, when appropriately lifted and tipped for dumping, such as by a vehicle-mounted dumping mechanism, for example, the refuse container 100 depicted in FIGS. 1-4 can release the contents therein.

The receptacle 110 disclosed in FIGS. 1-4 includes a wheeled cart. For example, the receptacle 110 comprises at least one wheel 118 (FIG. 1), which can facilitate rolling movement of the receptacle 110. The depicted receptacle 110 further includes a body 114 and a rim 112. The rim 112 can extend around the perimeter of the receptacle 110. For example, the rim 112 can define the opening through which refuse is deposited into the receptacle 110 and through which refuse is dumped from the receptacle 110. In other instances, the rim 112 can extend around a portion of the perimeter of the receptacle 110.

Referring still to FIGS. 1-4, the rim 112 can define an outer diameter of the receptacle 110. For example, the rim 112 can protrude outward past the body 114 of the receptacle 110. In other instances, the rim 112 may not protrude outward past the body 114, or may only protrude outward past the body 114 around a portion of the perimeter of the receptacle 110. Additionally, referring to FIG. 1, the rim 112 comprises a generally polygonal perimeter. For example, the depicted rim 112 include multiple flat or planar sides. In certain instances, a substantial majority of the rim 112 can consist of flat or planar sides, for example, and a small minority of the rim 112 can consist of rounded sides and/or corners between the flat sides, for example.

In various instances, the body 114 of the receptacle 110 and/or the lid 120 can be made from a variety of processes. For example, the body 114 of the receptacle 110 and/or the lid 120 can be rotationally-molded, injection molded, blow molded, and/or vacuum molded. Rotationally-molded methods are described in U.S. Pat. No. 5,776,405 to J. Timothy Prout et al., entitled METHOD FOR MOLDING A ROTATIONALLY-MOLDED CONTAINER, which issued on Jul. 7, 1998 and/or in U.S. Pat. No. 5,922,267 to Anthony J. Brescia et al., entitled METHOD FOR MAKING A ROTATIONALLY MOLDED CONTAINER RIM, which issued on Jul. 13, 1999, which are hereby incorporated by reference herein in their respective entireties. In various instances, the receptacle 110, including the rim 112 and the body 114 thereof, can be strong and rigid such that the receptacle is sufficiently sturdy and resists deformation.

Referring still to FIGS. 1-4, the lid 120 of the depicted refuse container 100 includes a lid rim 122. The depicted lid rim 122 extends around the perimeter of the lid 120. In other instances, the lid rim 122 can extend around a portion of the perimeter of the lid 120. The lid 120 disclosed in FIGS. 1-4 is moveable between a closed position (FIG. 4) and an open position (FIGS. 1-3) relative to the receptacle 110. For example, the lid 120 includes hinges 124 (FIG. 1), which pivotably connect the lid 120 to the receptacle 110. In such instances, the lid 120 can pivot between a range of positions, including an open position (FIG. 4) and the closed position (FIGS. 1-3), for example.

When the lid is in the closed position (FIGS. 1-3), the lid rim 122 can be positioned adjacent to the receptacle rim 112. For example, the lid rim 122 can rest on the receptacle rim 112, and can be held in place by gravity. In various instances, the receptacle rim 112 can protrude or project outward of the lid rim 122 (FIGS. 2 and 3). In other instances, at least a portion of the receptacle rim 112 and the lid rim 122 can be aligned and/or at least a portion of the lid rim 122 can protrude or project outward of the receptacle rim 112, for example.

The refuse container 100 disclosed in FIGS. 1-4 includes the latch 20 mounted to the lid 120. The latch 20 can operably engage the receptacle 110 to latch or secure the container 100, and can operably disengage the receptacle 110 to unlatch the container 100, for example.

The latch 20 is further depicted in FIGS. 5-9. Referring primarily to FIGS. 5-9, the latch 20 includes a flexible body 22. The flexible body 22 of the latch 20 can be configured to move between a range of positions. For example, the flexible body 22 can flex between a first configuration (see, e.g., FIG. 7) and a second configuration (see, e.g., FIG. 8). As described in greater detail herein, flexing of the body 22 can facilitate latching and unlatching of the container 100 (FIGS. 1-4). In various instances, the body 22 can be flexed to a deformed configuration (see, e.g., FIG. 8) to latch the lid 120 to the receptacle 110 of the container 100. For example, when the latch 20 is engaged with the receptacle 110 (FIGS. 1-3), the body 22 of the latch 20 can be deformed such that the flexible body 22 bends around a portion of the rim 112 of the receptacle 110. When the latch 20 is disengaged from the receptacle 110, the body 22 can rebound to an undeformed configuration (see, e.g., FIG. 7).

In certain instances, the latch 20 can include a mounting portion 30 and an arm 40. A contour 44 can be defined intermediate the mounting portion 30 and the arm 40. In various instances, the flexible body 22 can bend at the contour 44 as the flexible body 22 moves between the first configuration and the second configuration. For example, referring to FIG. 7, an angle $\alpha$ can be defined at the contour 44 between the mounting portion 30 and the arm 40 when the flexible body 22 is unflexed and/or undeformed. Furthermore, referring to FIG. 8, an angle $\beta$ can be defined at the contour 44 between the mounting portion 30 and the arm 40 when the flexible body 22 is flexed around the rim 112 (FIGS. 1-3) of the receptacle 110. The angle $\beta$ can be different than the angle $\alpha$. Referring still to FIG. 8, when the flexible body 22 is flexed around the receptacle rim 112, the mounting portion 30 can be deformed and can assume a radius of curvature r, for example.

Referring primarily to FIGS. 1-4, the latch 20 can be mounted to the lid rim 122. When the latch 20 is mounted to the lid rim 122 and the lid 120 is in the closed position (FIGS. 1-3), the latch 20 can extend past the receptacle rim 112. The portion of the latch 20 that extends past the receptacle rim 112 can be in abutting engagement with a portion of the receptacle rim 112, which can deform the flexible body 22 of the latch 20. For example, referring primarily to FIG. 3, the latch 20 can include a rim-facing surface 24, which can be positioned adjacent to the rim 122 of the lid 120 when the latch 20 is mounted to the lid rim 122. Moreover, a portion of the rim-facing surface 24 can be positioned adjacent to the rim 112 of the receptacle 110 when the lid 120 is in the closed position. As a result, the receptacle rim 112 abuts the rim-facing surface 24 and can deforms the flexible body 22.

The mounting portion 30 of the latch 20 can be mounted or otherwise secured to the lid 120. For example, referring again to FIG. 3, the latch 20 can be secured to the lid rim 122 with a mounting bracket 36 and at least one fastener or screw 34. For example, the mounting portion 30 of the latch 20 can include at least one threaded aperture 32 (FIGS. 5 and 6), which can be dimensioned and structured to threadably receive a screw 34. In other instances, the latch 20 can be permanently fixed to the lid 120. For example, the latch 20 can be bonded to the lid 120 and/or can be integrally formed with the lid 120.

When the lid 120 is closed (FIGS. 1-3), the arm 40 of the latch 20 can extend past the receptacle rim 112 and can releasably engage the receptacle rim 112 to secure the lid 120 to the receptacle 110. For example, the arm 40 of the latch 20 can include a support 50, which protrudes from the rim-facing surface 24 of the latch 20. The support 50 can project toward the receptacle 110, and/or can protrude under and/or around the receptacle rim 112 when the lid 120 is closed. For example, the receptacle rim 112 can be positioned between the support 50 and the mounting portion 30 of the latch 20. The support 50 disclosed in FIGS. 1-9 includes a first side or first wall 52 protruding from the rim-facing surface 24 of the arm 40 and a second side or second wall 54 protruding from the rim-facing surface 24 of the arm 40. In various instances, the first side 52 can extend to the second side 54, and a triangular opening 51 can be defined between the first side 52, the second side 54, and the rim-facing surface 24 of the arm 40.

Referring to FIG. 8, in various instances, the first side 52 can extend from the arm 40 at a first angle θ, and the second side 54 can extend from the arm 40 at a second, different angle ϕ. The first angle θ can be between approximately 90 degrees and 180 degrees, for example, and the second angle ϕ can be between approximately 45 degrees and 135 degrees, for example. In certain instances, the first angle θ can be approximately 135 degrees, for example, and the second angle ϕ can be approximately 100 degrees, for example. In other instances, the first angle θ can equal, or generally equal, to the second angle ϕ. In other instances, the second angle ϕ can be greater than the first angle θ. Additionally or alternatively, in various instances, the support 50 can include additional sides, which can define a non-triangular opening therebetween.

Figure 7:
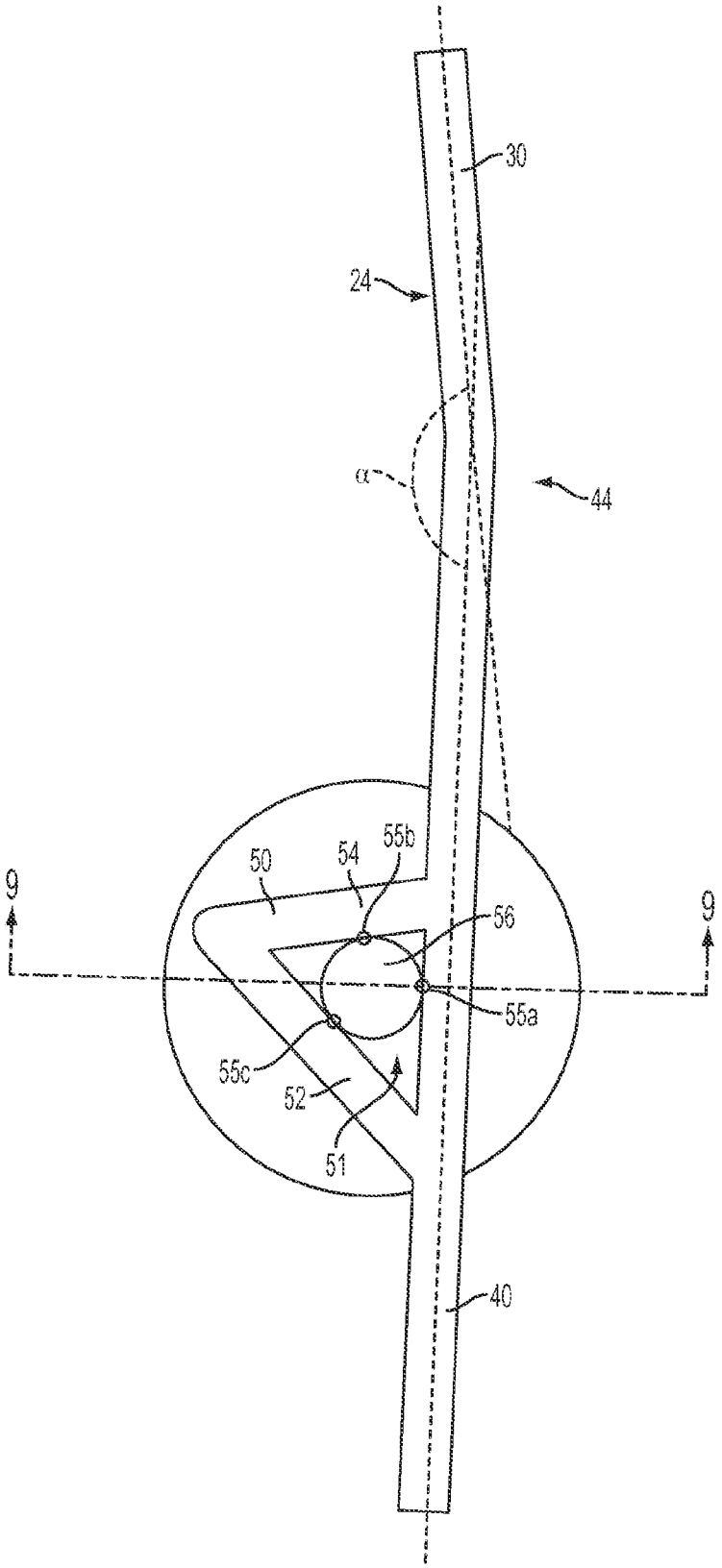
FIG. 7 is an elevation view of the latch of FIG. 5, depicting the latch in the unflexed orientation, according to various embodiments of the present disclosure.
Figure 8:
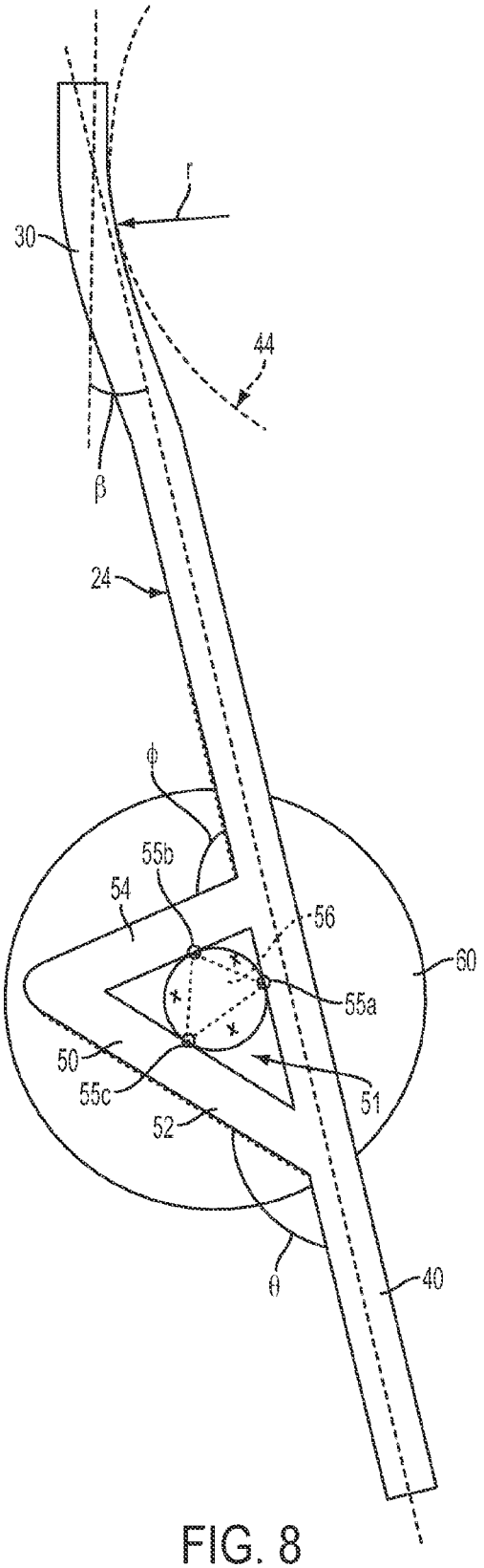
FIG. 8 is another elevation view of the latch of FIG. 5, depicting the latch in the flexed orientation, according to various embodiments of the present disclosure.
Figure 9:
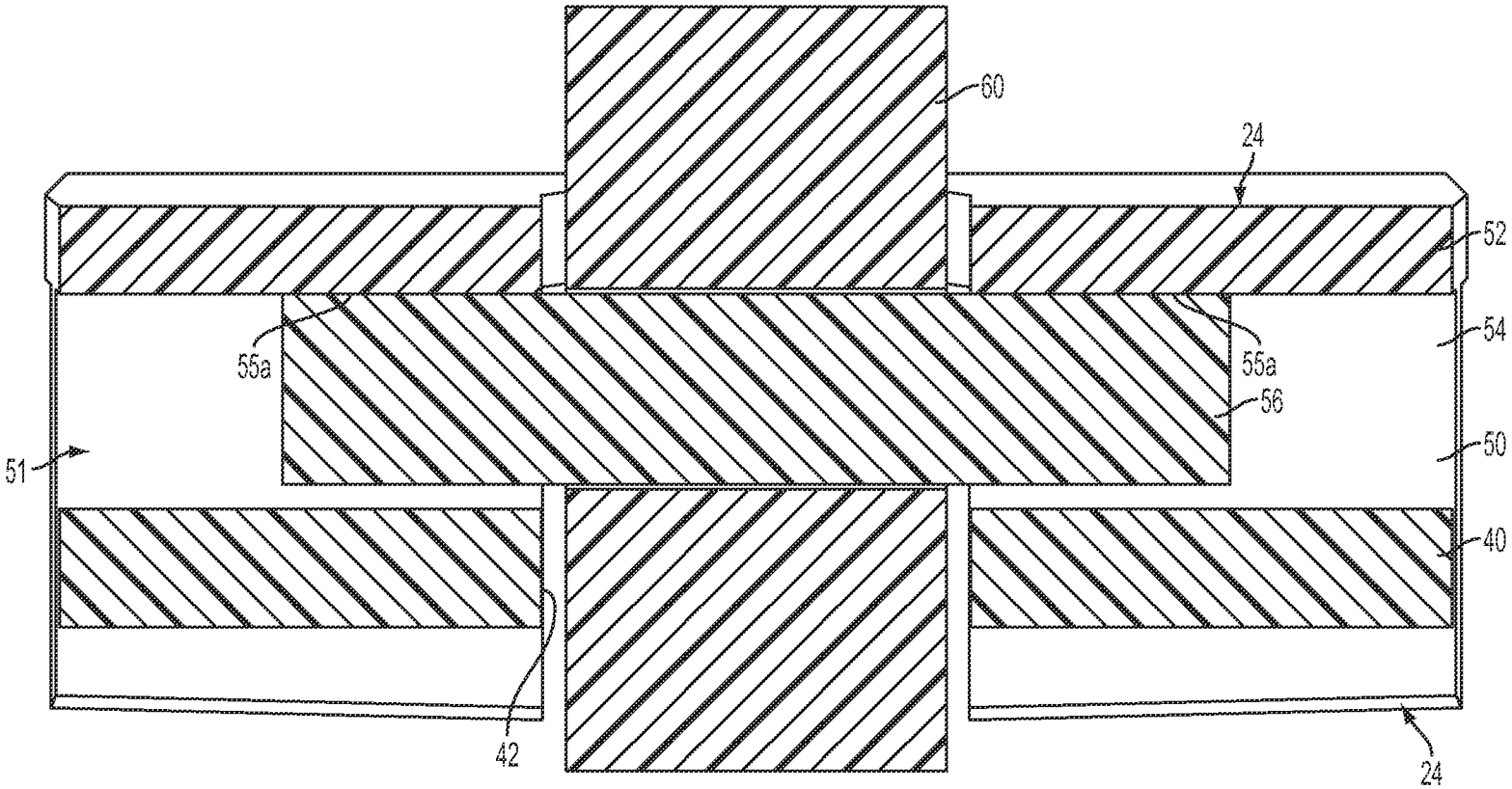
FIG. 9 is a cross-sectional, elevation view of the latch of FIG. 5, taken along a plane 9-9 depicted in FIG. 7, according to various embodiments of the present disclosure.

Referring primarily to FIGS. 7-9, the latch 20 can also include an axle 56, which can be retained or held in position by the support 50 and the arm 40. For example, the axle 56 can be secured between the first wall 52 of the support 50, the second wall 54 of the support 50, and the rim-facing side 24 of the arm 40. In various instances, the axle 56 can be held in place by interference with the support 50 and/or the arm 40. For example, the axle 56 can be press fit or friction fit into the opening 51 defined by the arm 40 and the support 50. For example, a plurality of contact or holding regions 55*a*, 55*b*, 55*b* can be positioned within the opening 51. The axle 56 can be held in abutting contacting with the holding regions 55*a*, 55*b*, 55*c* to secure the axle 56 within the opening 51. In certain instances, the holding regions 55*a*, 55*b*, 55*c* can be equally-spaced around the opening 51. For example, an interval or space x (FIG. 8) can extend between adjacent holding regions 55*a*, 55*b*, 55*c*. In other instances, the axle 56 can be secured to the support 50 and/or the arm 40 by an adhesive and/or fastener, for example.

Figure 2:
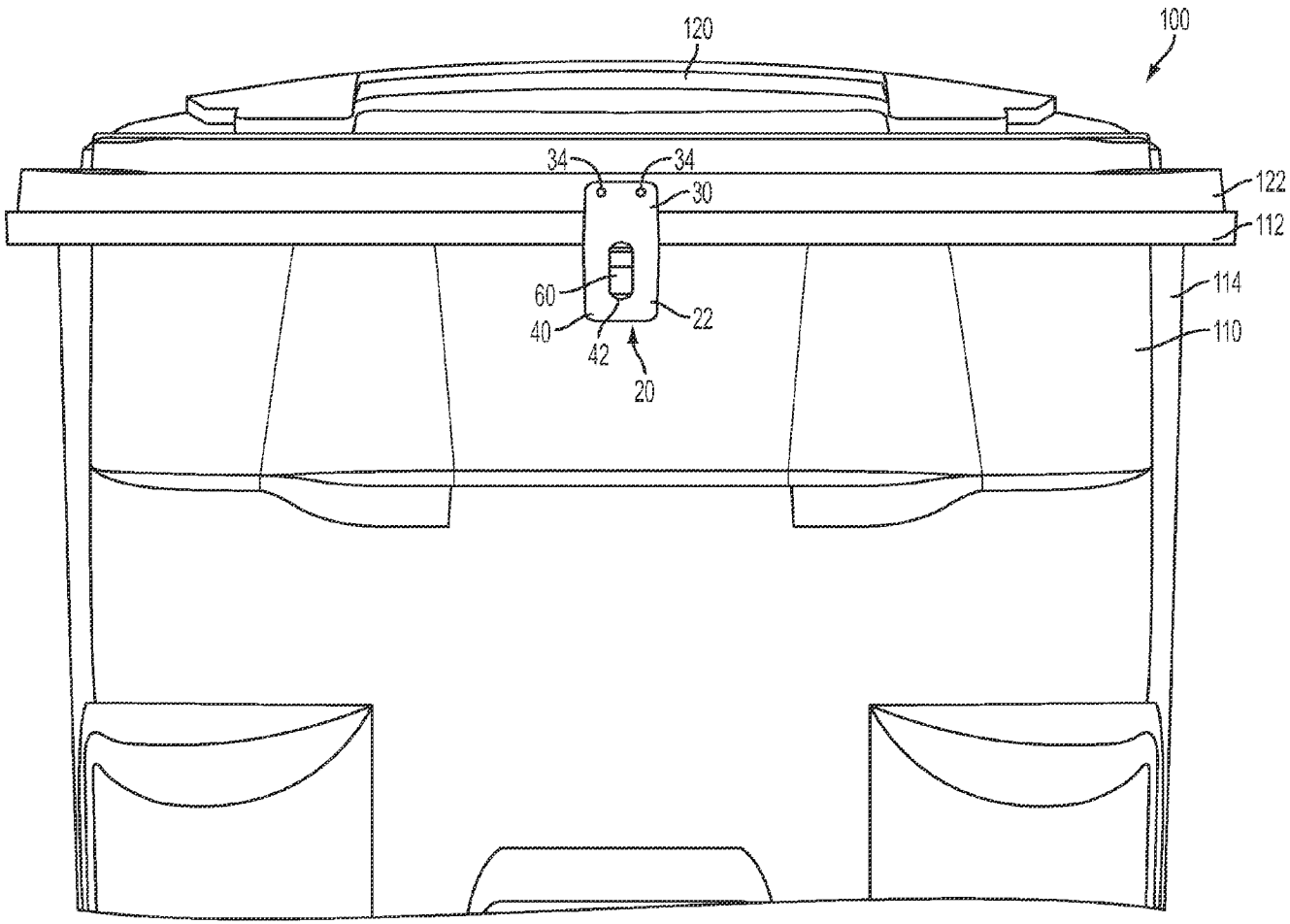
FIG. 2 is partial, elevation view of the refuse container of FIG. 1, depicting the hinged lid in the closed position relative to the receptacle, according to various embodiments of the present disclosure.
Figure 3:
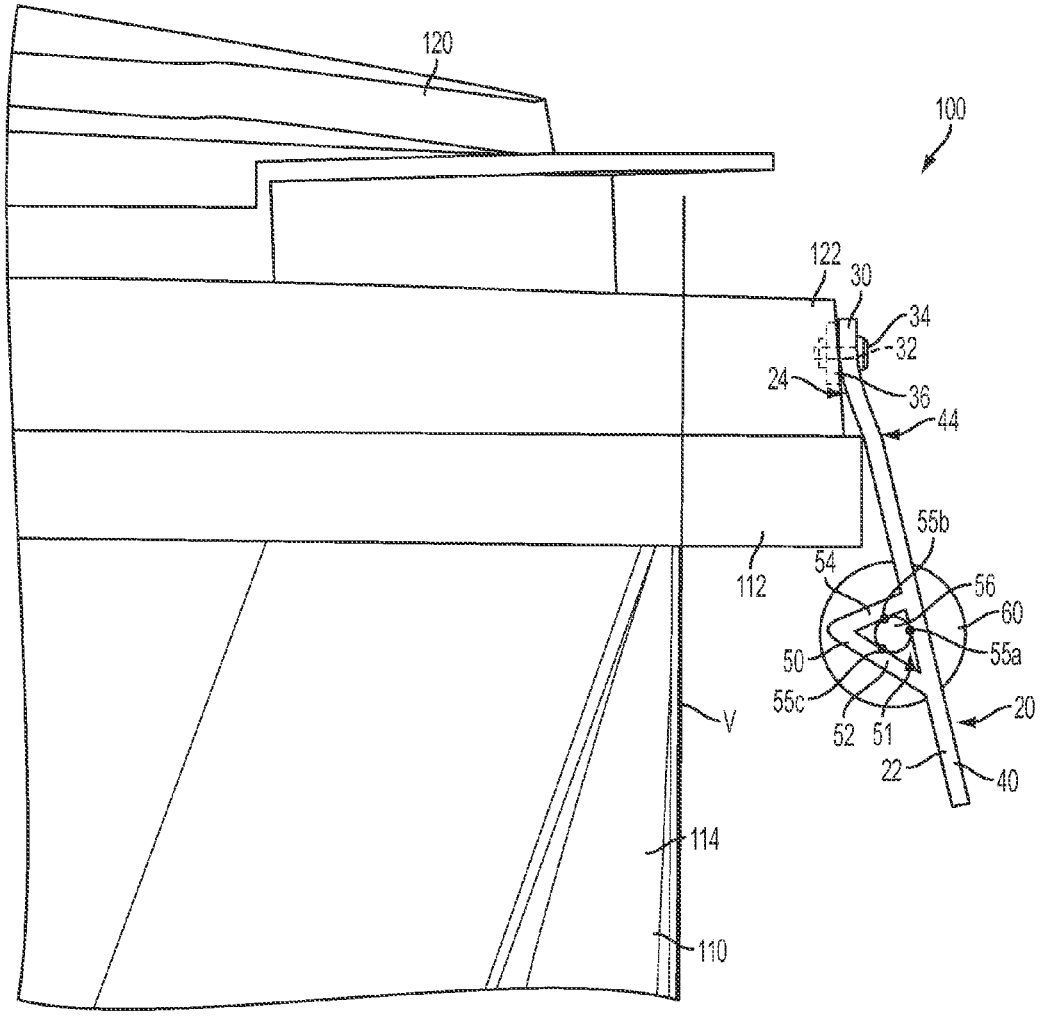
FIG. 3 is another partial, elevation view of the refuse container of FIG. 1, depicting the hinged lid in the closed position relative to the receptacle, and further depicting the latch in the flexed orientation, according to various embodiments of the present disclosure.
Figure 4:
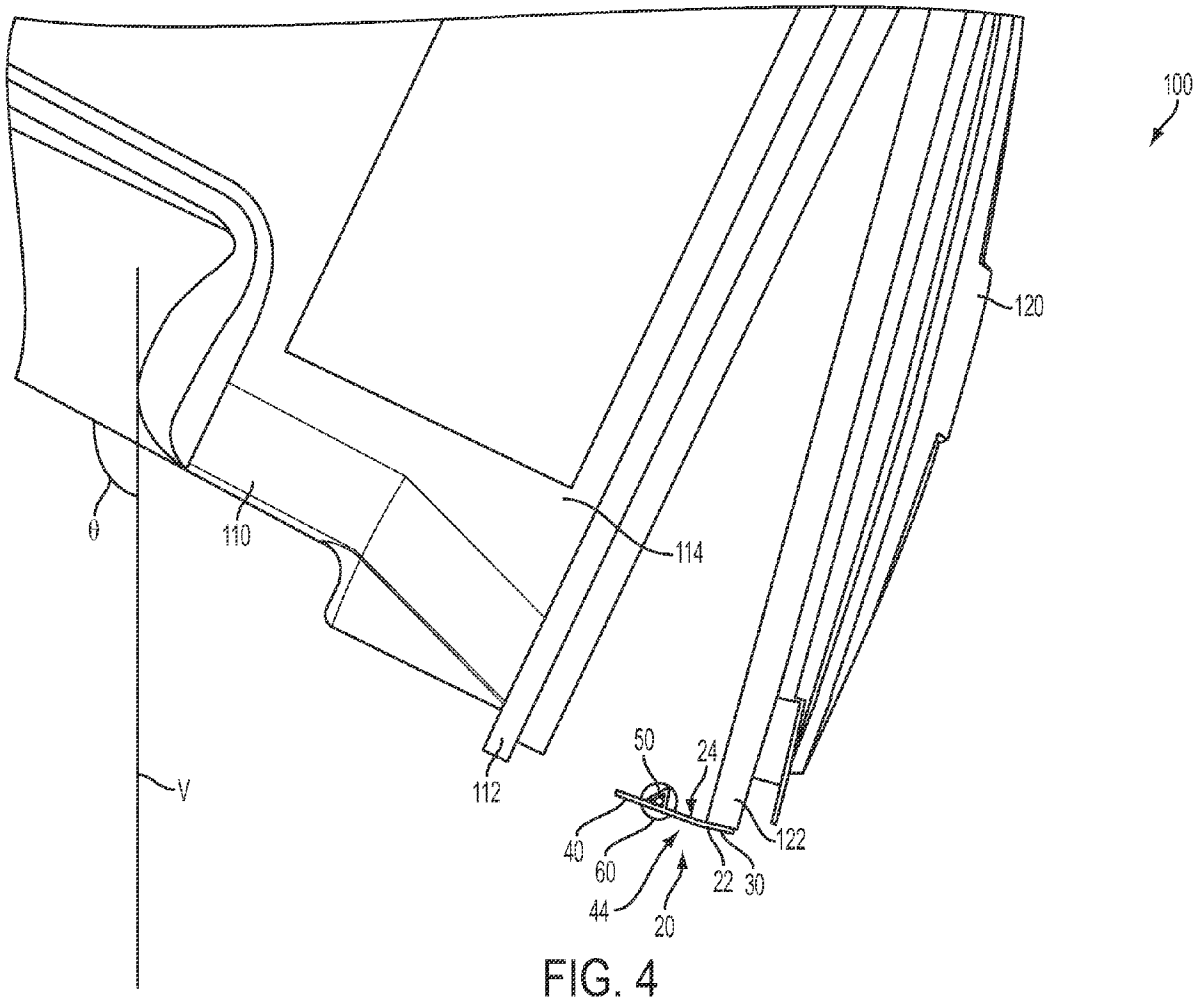
FIG. 4 is another partial, elevation view of the refuse container of FIG. 1, depicting the hinged lid in an open position relative to the receptacle, and further depicting the latch in an unflexed orientation, according to various embodiments of the present disclosure.
Figure 5:
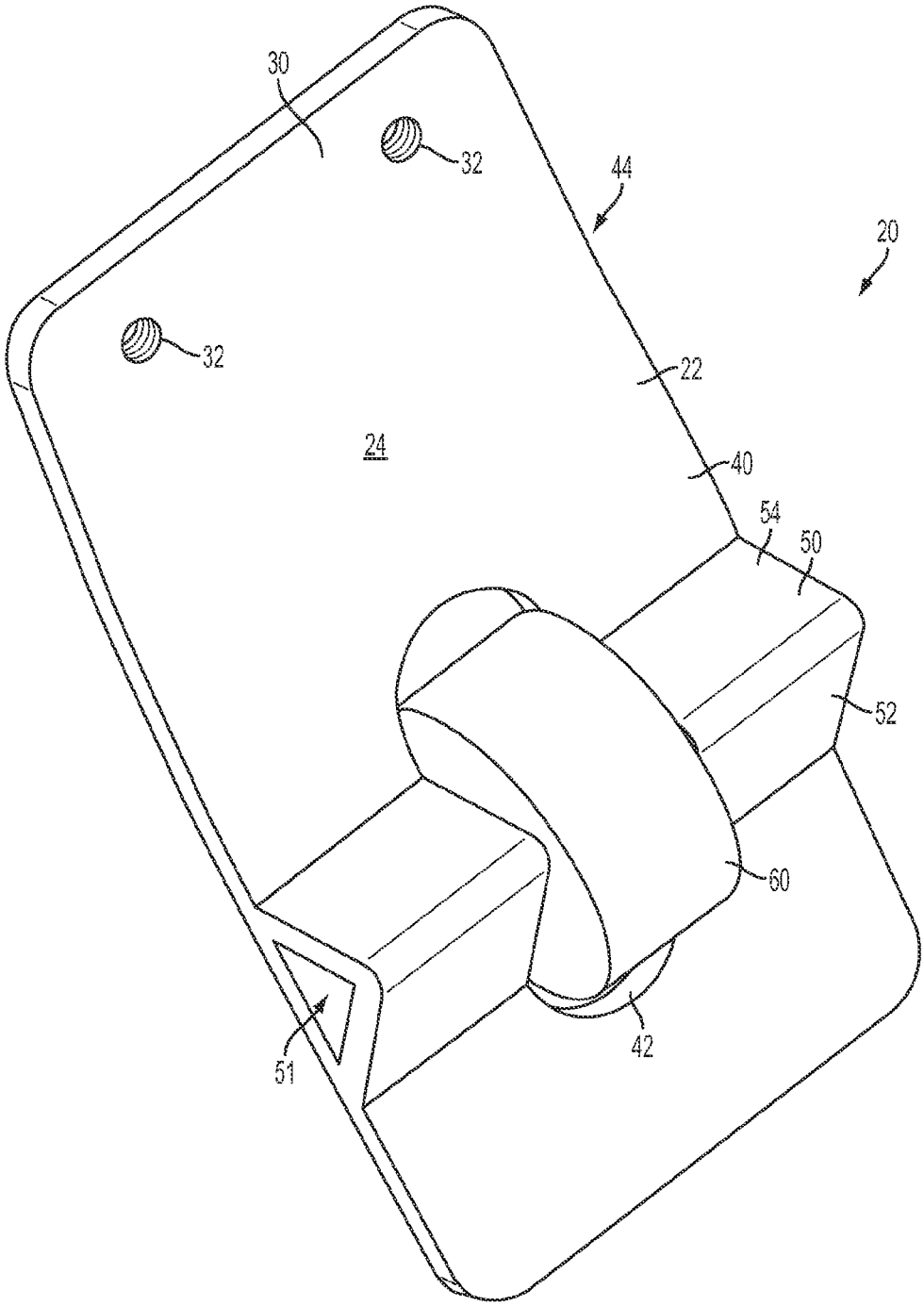
FIG. 5 is a perspective view of the latch of FIG. 1, depicting the latch in the unflexed orientation, according to various embodiments of the present disclosure.
Figure 6:
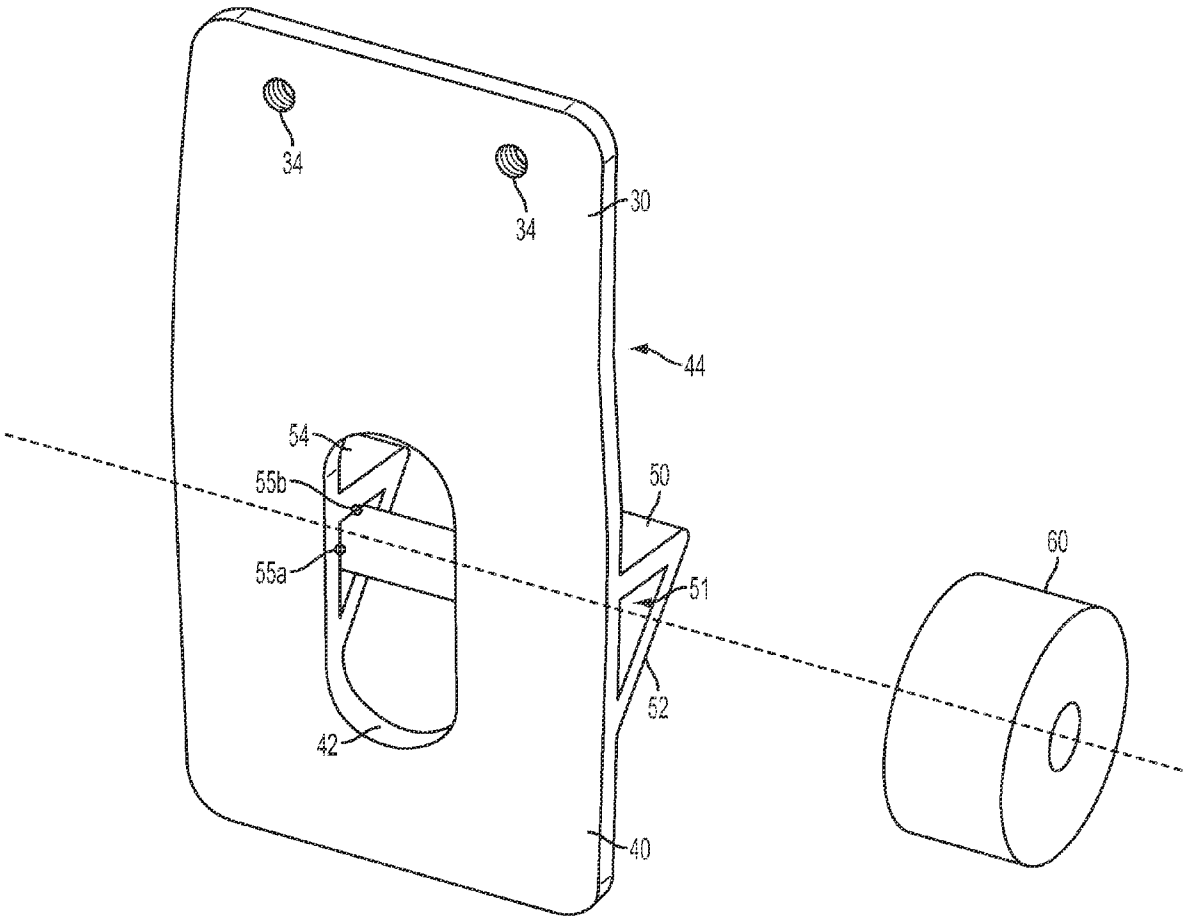
FIG. 6 is an exploded perspective view of the latch of FIG. 5, depicting the latch in the unflexed orientation, according to various embodiments of the present disclosure.

The latch 20 disclosed in FIGS. 1-9 includes a wheel 60, which can be supported by the axle 56. In various instances, the wheel 60 can be positioned around the axle 56. In various instances, the wheel 60 can protrude under and/or around the receptacle rim 112 when the lid 120 is closed (FIGS. 1-3). For example, the lid rim receptacle rim 112 can be positioned between the wheel 60 and the mounting portion 30 of the latch 20. Additionally, an opening 42 can be defined through the arm 40, and a portion of the wheel can protrude through the opening 42. In other instances, the wheel 60 can be offset from the arm 40 and may not protrude through an opening therein. For example, the distance between the axle 56 and the arm 40 can be greater than the diameter of the wheel 60. In certain instances, the wheel 60 may not rotate relative to the arm 40. For example, the wheel 60 can comprise a camming surface that operably engages and disengages the receptacle rim 112.

In various instances, the wheel 60 can rotate relative to the body 22. For example, the wheel 60 can be freely rotatable on the axle 56. As described in greater detail herein, the wheel 60 can rotate as the latch 20 moves between the latched position and the unlatched position and/or as the lid 120 moves between an open position (FIG. 4) and the closed position (FIGS. 1-3). In various instances, the wheel 60 can have a diameter greater than ½ inch and/or less than 2 inches. For example, the wheel 60 can have a diameter of approximately 1 inch. In other instances, the diameter of the wheel 60 can be less than ½ inch or greater than 2 inches. In various instances, the diameter of the wheel 60 can be selected such that a portion of the wheel 60 extends below the receptacle rim 112 when the lid 120 is closed (FIGS. 1-3).

The size of the wheel 60 can be changed to adjust the force required to release the latch 20 and/or to modify the maximum wind speed that the latch 20 can withstand without prematurely and/or inadvertently releasing the lid 120 from the receptacle 110. For example, if the diameter of the wheel 60 is decreased, more force may be required to release the latch 20. Additionally, in such instances, the latch 20 may withstand higher wind speeds. Conversely, if the diameter of the wheel 60 is increased, less force may be required to release the latch 20.

In various instances, the latch 20 can be comprised of high density polyethylene. In other instances, the latch 20 can be comprised of another suitable material to facilitate flexing of the body 22 between the unflexed orientation (FIG. 7) and a flexed orientation (FIG. 8), as described herein.

In use, the latch 20 can be mounted or otherwise secured to the rim 122 of the lid 120. For example, the mounting portion 30 of the latch 20 can be mounted to the rim 122 via a mounting bracket 36, threaded aperture(s) 32, and/or fastener(s) 34. When the lid 120 is moved from an open position (FIG. 4) to the closed position (FIGS. 1-3), the flexible body 22 of the latch 20 can bend or flex as the arm 40 moves past the rim 112 of the receptacle 110. For example, the body 22 can bend at the contour 44 as the support 50, axle 56, and/or the wheel 60 move past the receptacle rim 112.

When the lid 120 is closed and the lid rim 122 is positioned adjacent to the receptacle rim 112 (FIGS. 1-3), the body 22 of the latch 20 can be deformed around the receptacle rim 112. Moreover, the support 50 can protrude from the rim-facing surface 24 of the body 22 toward the receptacle 110, such that the wheel 60 extends under the receptacle rim 112. The wheel 60 can rotate as the wheel 60 moves past the receptacle rim 112. For example, the wheel 60 can rotate along the outer surface of the receptacle rim 112 as the wheel 60 moves past the receptacle rim 112.

When the lid 120 is closed and the latch 20 is secured around the receptacle rim 112, the contents of the container 100 can be secured and the lid 120 can resist premature opening of the container 100, even in windy or severe weather. Additionally, the lid 120 can easily open when the container 100 is engaged by a dumping mechanism. For example, when a dumping mechanism engages the container 100, the dumping mechanism can grasp or squeeze the body 114 of the receptacle 110. Thereafter, the dumping mechanism can lift the receptacle and tip or tilt the receptacle 110. For example, referring to FIGS. 3 and 4, the dumping mechanism can tilt the receptacle to angle θ relative to a vertical axis V and permit gravity and/or the contents in the receptacle 110 to unlatch the latch 20 and affect opening of the lid 120. In various instances, the receptacle 110 can be tilted and/or rotated between 100 degrees and 200 degrees by a dumping mechanism. For example, a dumping mechanism can tip the receptacle approximately 120 degrees to empty the container 100. As the container 100 is tipped, the weight of the lid 120 and/or the contents of the receptacle 110 bearing on the lid 120 can overcome the latch 20 to permit the lid 120 to open.

In various instances, a dumping mechanism can be mounted to a refuse-collection vehicle. Such a dumping mechanism can include an arm that grasps the body of the receptacle 110. When the dumping mechanism grips the sides of the receptacle body 114, the body 114 may deform slightly inward under the grasping force, which can cause the rim 112 to deform slightly outward. When the rim 112 expands, the latch 20 can flex to accommodate the expanding rim 112. Despite expansion of the rim 112, the wheel 60 of the latch 20 can rotate along the expanded rim 112 to disengage the receptacle 110 and permit the lid 120 to open. In various instances, the flexibility, dimensions, and structure of the latch 20 can be selected to permit unlatching and opening of the lid 120 when a predefined amount of force is applied to the lid. For example, the latch 20 can be configured to unlatch when approximately 2 pounds of force is applied to the inside surface of the lid 120 from the contents within the container 100. In other instances, the latch 20 can be configured to unlatch when less than 2 pounds of force or greater than 2 pounds of force is applied to the inside surface of the lid 120 from the contents within the container 100.

As the lid 120 moves to an open orientation (FIG. 4), the latch 20 can deflect or flex as the support 50, the axle 56, and/or the wheel 60 move past the receptacle rim 112. Moreover, in various instances, the wheel 60 can rotate along the outer surface of the receptacle rim 112 as the wheel 60 moves past the receptacle rim 112 and the latch 20 disengages the receptacle 110. Thereafter, the latch 20 can resume its initial, unflexed orientation (FIG. 7), and the lid 120 can hinge open relative to the receptacle 110 (FIG. 4) such that the container 100 can be emptied.

The refuse container 100 described herein can be used to collect and/or store various types of refuse, waste, litter, garbage, and/or recyclables. The reader will further appreciate that the latch 20 described herein can be employed to secure various lidded containers, which may be subjected to windy conditions. In certain instances, the latch 20 can be employed with a storage container and/or non-refuse container, for example.

Figure 10:
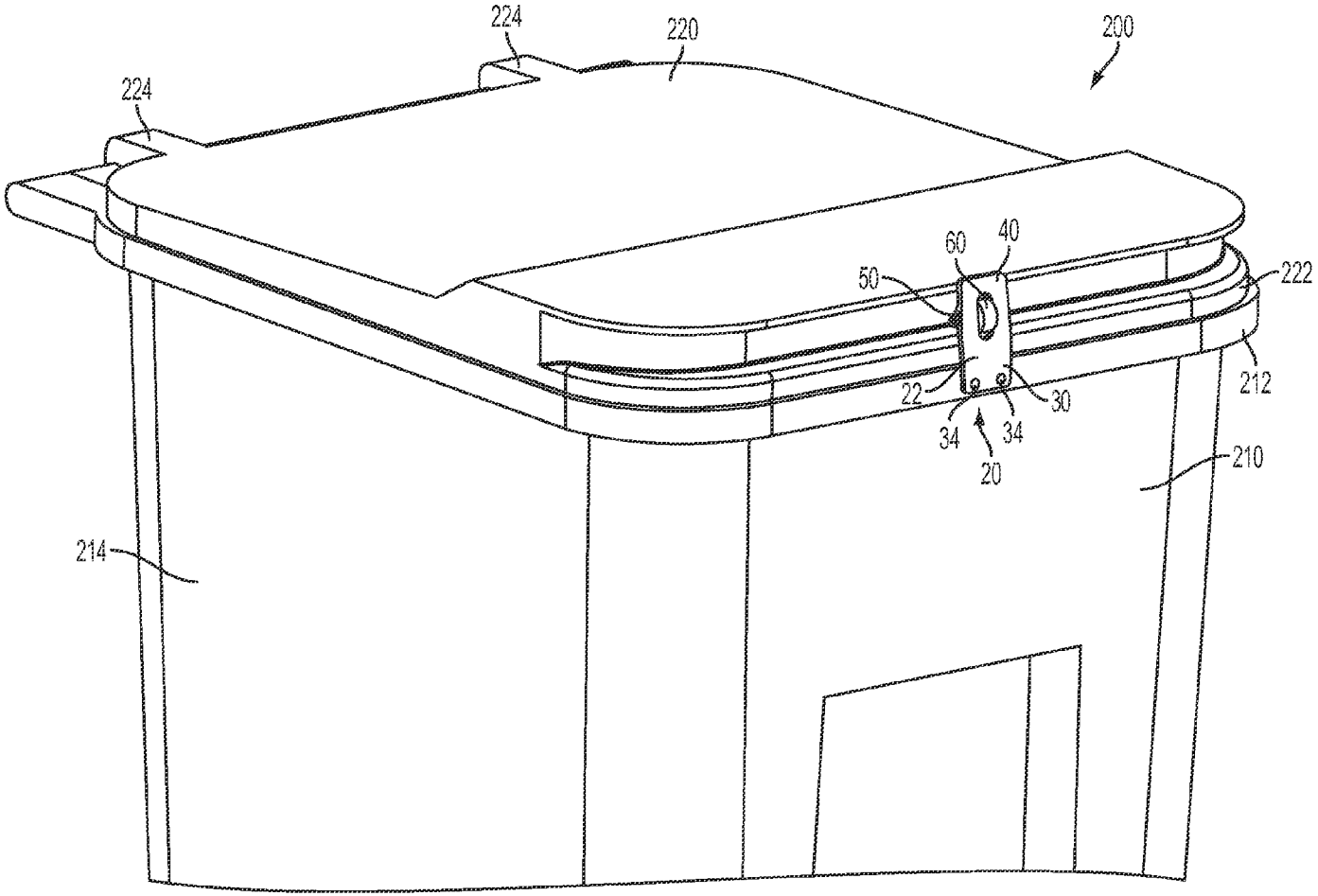
FIG. 10 is a partial, perspective view of a refuse container including a wheeled receptacle, a hinged lid, and the latch of FIG. 5, depicting the lid in a closed position relative to the receptacle, according to various embodiments of the present disclosure.
Figure 11:
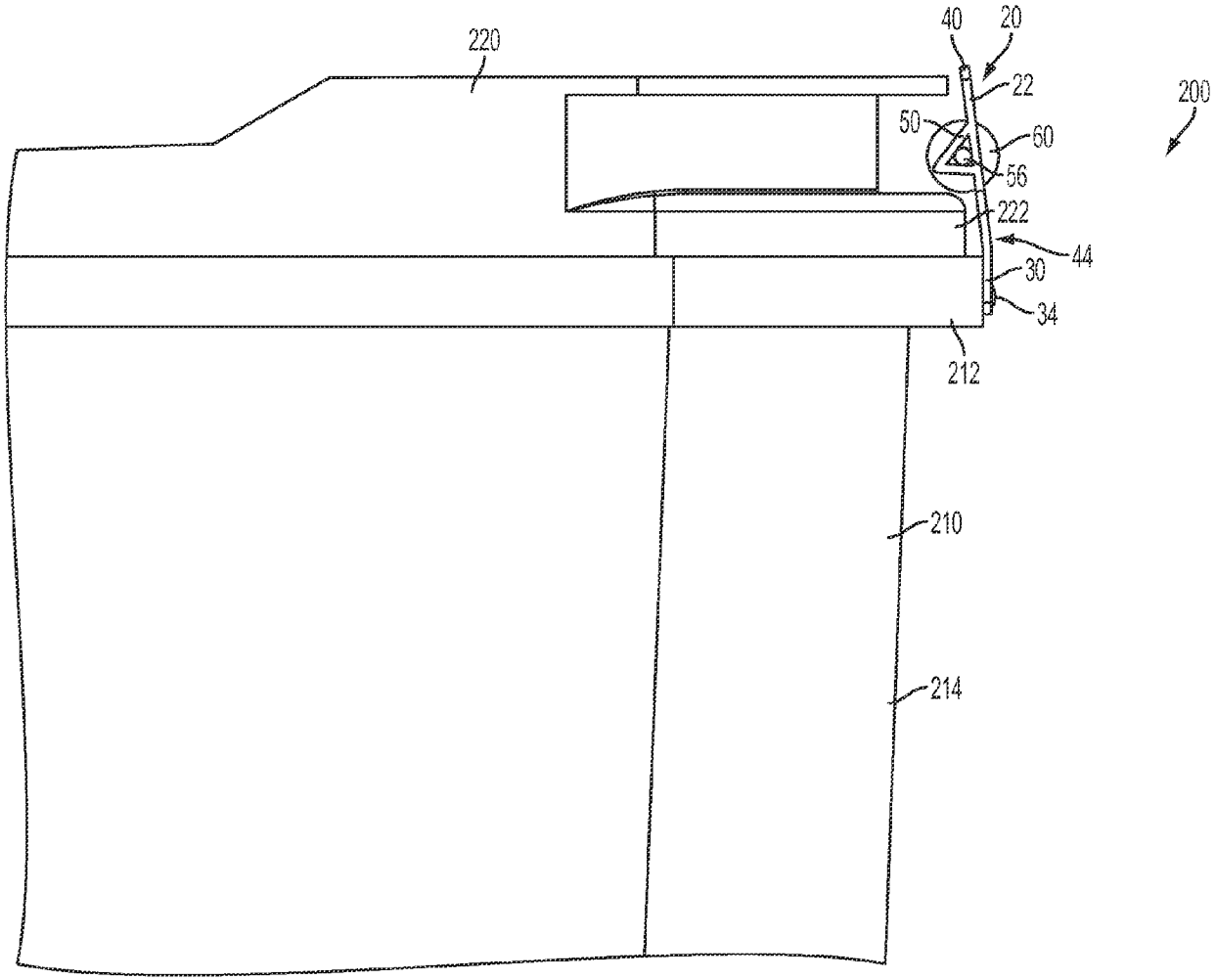
FIG. 11 is a partial, elevation view of the refuse container of FIG. 10, depicting the lid in the closed position relative to the receptacle, according to various embodiments of the present disclosure.
Figure 12:
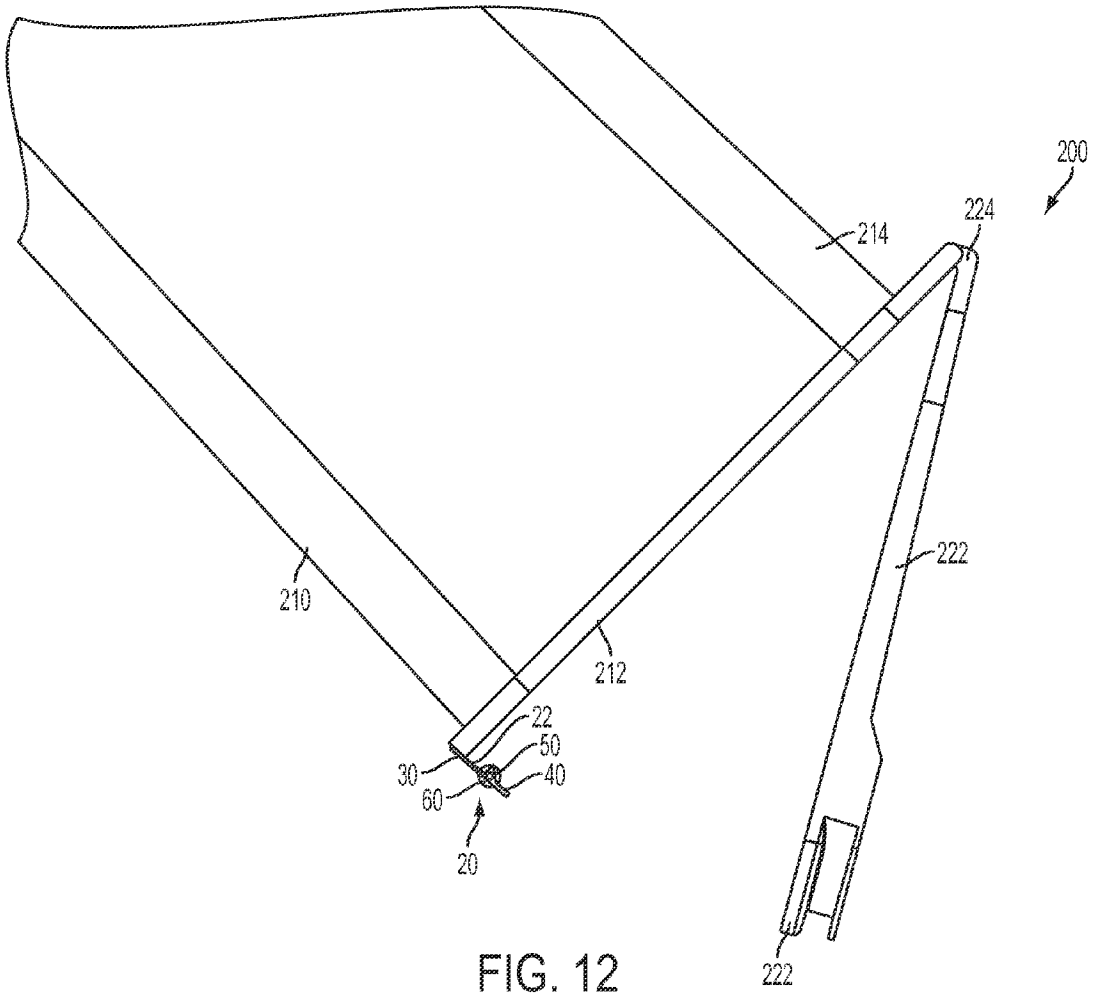
FIG. 12 is a partial, elevation view of the refuse container of FIG. 10, depicting the lid in an open position relative to the receptacle, according to various embodiments of the present disclosure.

For example, a refuse container 200 is disclosed in FIGS. 10-12. The container 200 includes a receptacle 210, a lid 220 and the latch 20, which can secure the lid 220 in a closed position (FIGS. 10 and 11) relative to the receptacle 210. Moreover, as described in greater detail herein, the latch 20 can operably permit movement of the lid 220 to an open position (FIG. 12) to facilitate dumping of the contents in the receptacle 210. As a result, the refuse container 200 depicted in FIGS. 10-12 can protect the contents thereof from natural elements, weather conditions, and wildlife, even when subjected to strong winds. Additionally, when appropriately lifted and tipped for dumping, see, e.g., FIG. 12, such as by a vehicle-mounted dumping mechanism, for example, the refuse container 200 depicted in FIGS. 10-12 can release the contents therein.

The receptacle 210 disclosed in FIGS. 10-12 includes a body 214 and a rim 212. The rim 212 can extend around the perimeter of the receptacle 210. For example, the rim 212 can define the opening through which refuse is deposited into the receptacle 210 and through which refuse is dumped from the receptacle 210. In other instances, the rim 212 can extend around a portion of the perimeter of the receptacle 210.

Referring still to FIGS. 10-12, the lid 220 of the depicted refuse container 200 includes a lid rim 222. The depicted lid rim 222 extends around the perimeter of the lid 220. In other instances, the lid rim 222 can extend around a portion of the perimeter of the lid 220. The lid 220 disclosed in FIGS. 10-12 is moveable between a closed position (FIG. 12) and an open position (FIGS. 10 and 11) relative to the receptacle 210. For example, the lid 120 includes hinges 224 (FIGS. 10 and 12), which pivotably connect the lid 220 to the receptacle 210. In such instances, the lid 220 can pivot between a range of positions, including an open position (FIG. 12) and the closed position (FIGS. 10 and 11), for example.

The mounting portion 30 of the latch 20 can be mounted or otherwise secured to the body 214 of the receptacle 210. For example, the latch 20 can be secured to the receptacle rim 212 with at least one fastener or screw 34. In some instances, the latch 20 can be permanently fixed to the receptacle 210. For example, the latch 20 can be bonded to the receptacle 210 and/or can be integrally formed with the receptacle 210. In use, when the lid 220 is moved from an open position (FIG. 12) to the closed position (FIGS. 10 and 11), the flexible body 22 of the latch 20 can bend or flex as the arm 40 moves past the rim 222 of the lid 220. For example, the body 22 can bend at the contour 44 as the support 50, axle 56, and/or the wheel 60 move past the lid rim 222.

When the lid 220 is closed and the lid rim 222 is positioned adjacent to the receptacle rim 212 (FIGS. 10 and 11), the body 22 of the latch 20 can be deformed around the lid rim 222. Moreover, the support 50 can protrude from the rim-facing surface 24 of the body 22 toward the lid 220, such that the wheel 60 extends over and/or around the lid rim 222. For example, the lid rim 222 can be positioned between the wheel 60 and the mounting portion 30 of the latch 20. The wheel 60 can rotate as the wheel 60 moves past the lid rim 222.

When the container 200 is lifted and tipped, such as by a dumping mechanism, for example, gravity and/or the contents in the receptacle 210 can cause the latch 20 to unlatch and affect opening of the lid 220. In various instances, the receptacle 210 can be tilted and/or rotated between 100 degrees and 200 degrees by a dumping mechanism. For example, the weight of the lid 220 and/or the contents of the receptacle 210 bearing on the lid 220 can overcome the latch 20 to permit the lid 220 to open.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

I claim:

1. A container, comprising:

a receptacle comprising a receptacle rim;

a lid movable between an open position and a closed position relative to the receptacle, wherein the lid comprises a lid rim, and wherein the lid rim is positioned adjacent to the receptacle rim when the lid is in the closed position; and a latch, comprising:

a flexible body mounted to the lid rim and extending past the receptacle rim when the lid is in the closed position; and a wheel rotatable relative to the flexible body, wherein the wheel protrudes under the receptacle rim when the lid is in the closed position;

wherein the flexible body further comprises an opening, and wherein a portion of the wheel protrudes through the opening.

2. The container of claim 1, wherein the lid is configured to pivot between the open position and the closed position.

3. The container of claim 1, wherein the flexible body further comprises:

a mounting portion mounted to the lid rim;

an arm extending from the mounting portion; and a contour intermediate the mounting portion and the arm, wherein the flexible body is configured to bend at the contour.

4. The container of claim 1, further comprising a mounting bracket configured to mount the flexible body to the lid rim.

5. The container of claim 4, wherein the latch further comprises a screw, and wherein the flexible body further comprises a threaded aperture structured and dimensioned to threadably receive the screw.

6. The container of claim 1, wherein the latch is permanently fixed to the lid.

7. The container of claim 1, wherein the wheel comprises a diameter greater than ½ inch.

8. The container of claim 7, wherein the wheel comprises a diameter less than 2 inches.

9. The container of claim 8, wherein the wheel comprises a diameter of approximately 1 inch.

10. The container of claim 1, wherein the latch is comprised of high density polyethylene.

11. The container of claim 1, wherein the receptacle comprises a rotationally molded receptacle body and a wheel.

12. A container, comprising:

a receptacle comprising a receptacle rim;

a lid movable between an open position and a closed position relative to the receptacle, wherein the lid comprises a lid rim, and wherein the lid rim is positioned adjacent to the receptacle rim when the lid is in the closed position; and a latch, comprising:

a flexible body mounted to the lid rim and extending past the receptacle rim when the lid is in the closed position;

a wheel rotatable relative to the flexible body, wherein the wheel protrudes under the receptacle rim when the lid is in the closed position;

an axle support protruding from the flexible body; and an axle, wherein the wheel is positioned around the axle;

wherein the axle support comprises:

a first side protruding from the flexible body at a first angle; and a second side protruding from the flexible body at a second angle and extending to the first side, wherein the first angle is different than the second angle.

13. The container of claim 12, wherein the axle is positioned between the first side of the axle support, the second side of the axle support, and the flexible body.

14. The container of claim 12, wherein the axle support extends under the receptacle rim when the lid is in the closed position.

15. The container of claim 12, wherein the wheel is configured to freely rotate as the lid moves between the open position and the closed position.

16. A lid for a refuse container, wherein the lid comprises:

a rim; and a latch mounted to the rim, wherein the latch comprises:

a body configured to flex between a first orientation and a second orientation, wherein the body comprises a rim side adjacent to the rim, and wherein the body extends past the rim of the lid;

a support protruding from the rim side of the body, wherein the support comprises a first side and a second side;

an axle retained between the first side, the second side, and the rim side of the body; and a wheel positioned around the axle, wherein the wheel is rotatable relative to the body;

wherein the body further comprises an opening, and wherein a portion of the wheel protrudes through the opening.

17. A container, comprising:

a receptacle comprising a receptacle rim;

a lid movable between an open position and a closed position relative to the receptacle, wherein the lid comprises a lid rim, and wherein the lid rim is positioned adjacent to the receptacle rim when the lid is in the closed position; and a latch, comprising:

a flexible body mounted to the receptacle rim and extending past the lid rim when the lid is in the closed position; and a wheel rotatable relative to the flexible body, wherein the wheel protrudes over the lid rim when the lid is in the closed position;

wherein the flexible body further comprises an opening, and wherein a portion of the wheel protrudes through the opening.

* * * * *